US009821926B2

(12) United States Patent
Robinson et al.

(10) Patent No.: US 9,821,926 B2
(45) Date of Patent: Nov. 21, 2017

(54) METHOD AND APPARATUS FOR FORMING A THREADED NECK ON A METALLIC BOTTLE

(71) Applicant: Ball Corporation, Broomfield, CO (US)

(72) Inventors: Greg Robinson, Boulder, CO (US); David J. Bonfoey, Thornton, CO (US); Dean L. Johnson, Littleton, CO (US); Anthony J. Scott, Westminster, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 14/212,545

(22) Filed: Mar. 14, 2014

(65) Prior Publication Data

US 2014/0263150 A1 Sep. 18, 2014

Related U.S. Application Data

(60) Provisional application No. 61/799,214, filed on Mar. 15, 2013.

(51) Int. Cl.
*B21D 51/38* (2006.01)
*B65D 1/02* (2006.01)
(Continued)

(52) U.S. Cl.
CPC ..... *B65D 1/0246* (2013.01); *B21D 51/2638* (2013.01); *B21D 51/38* (2013.01); *B65D 1/023* (2013.01); *B65D 41/04* (2013.01)

(58) Field of Classification Search
CPC .... B65D 1/0246; B65D 1/0207; B65D 1/023; B65D 41/04; B21D 51/50; B21D 51/38; B21D 51/2638
(Continued)

(56) References Cited

U.S. PATENT DOCUMENTS 2,116,199 A * 5/1938 Held ..... B21D 51/24 220/906
3,144,964 A 8/1964 Goff et al.
(Continued)

FOREIGN PATENT DOCUMENTS

CA 707608 4/1965
CA 720701 11/1965
(Continued)

OTHER PUBLICATIONS

International Search Report and Written Opinion for International Patent Application No. PCT/US2014/028303, dated Oct. 3, 2014, 12 pages.

(Continued)

*Primary Examiner* — Jimmy T Nguyen
(74) *Attorney, Agent, or Firm* — Sheridan Ross PC

(57) ABSTRACT

An apparatus and method of making and applying threaded twist-off neck finishes for metal containers is provided. More specifically, the present invention relations to apparatus and methods used to form metallic bottles with threaded necks adapted to receive selectively removable threaded closures. The threaded neck may be formed by interconnecting a threaded outsert to a metallic bottle. Alternatively, the threaded neck may be formed as an integral portion of the neck of the bottle.

11 Claims, 8 Drawing Sheets

(51) Int. Cl.
*B65D 41/04* (2006.01)
*B21D 51/26* (2006.01)

(58) Field of Classification Search
USPC ..... 413/23; 215/42, 44, 288, 669
See application file for complete search history.

(56) References Cited

U.S. PATENT DOCUMENTS

| | | | | |
|---|---|---|---|---|
| 3,164,287 | A | 1/1965 | Williamson | |
| 3,227,318 | A | 1/1966 | Rieder | |
| 3,578,223 | A | 5/1971 | Armour | |
| 3,603,472 | A * | 9/1971 | Lecinski, Jr. ..... | B65D 41/08 215/253 |
| 4,403,493 | A | 9/1983 | Atkinson | |
| 4,693,108 | A | 9/1987 | Traczyk et al. | |
| 4,732,027 | A | 3/1988 | Traczyk et al. | |
| 4,823,537 | A | 4/1989 | Duke | |
| 5,138,858 | A | 8/1992 | Johnson et al. | |
| 5,255,805 | A | 10/1993 | Weiss et al. | |
| 5,293,765 | A | 3/1994 | Nussbaum-Pogacnik | |
| 5,448,903 | A | 9/1995 | Johnson | |
| 5,469,729 | A | 11/1995 | Hager | |
| 5,704,240 | A | 1/1998 | Jordan | |
| 5,713,235 | A | 2/1998 | Diekhoff | |
| 5,718,352 | A | 2/1998 | Diekhoff et al. | |
| 5,778,723 | A | 7/1998 | Diekhoff | |
| 5,822,843 | A | 10/1998 | Diekhoff et al. | |
| 6,010,026 | A | 1/2000 | Diekhoff et al. | |
| 6,010,028 | A | 1/2000 | Jordan et al. | |
| 6,341,706 | B1 | 1/2002 | Neuner | |
| 6,375,020 | B1 * | 4/2002 | Marquez ..... | B65D 1/0207 215/232 |
| 6,588,614 | B2 | 7/2003 | Neuner | |
| 6,779,677 | B2 | 8/2004 | Chupak | |
| 6,907,653 | B2 | 6/2005 | Chupak | |
| 7,140,223 | B2 | 11/2006 | Chupak | |
| 7,503,741 | B2 | 3/2009 | Gillest | |
| 7,555,927 | B2 | 7/2009 | Hanafusa et al. | |
| 7,798,357 | B2 | 9/2010 | Hanafusa et al. | |
| 7,942,028 | B2 | 5/2011 | Gillest et al. | |
| 7,946,436 | B2 | 5/2011 | Laveault et al. | |
| 8,016,148 | B2 | 9/2011 | Walsh | |
| 8,037,734 | B2 | 10/2011 | Hanafusa et al. | |
| 8,132,439 | B2 | 3/2012 | Hanafusa et al. | |
| 8,505,350 | B2 | 8/2013 | Marshall et al. | |
| 9,227,748 | B2 | 1/2016 | Nakagawa et al. | |
| 2003/0102278 | A1 | 6/2003 | Chupak | |
| 2003/0132188 | A1 | 7/2003 | Beek et al. | |
| 2005/0067365 | A1 | 3/2005 | Hanafusa et al. | |
| 2005/0127077 | A1 | 6/2005 | Chupak | |
| 2007/0051687 | A1 | 3/2007 | Olson | |
| 2007/0062952 | A1 | 3/2007 | Kobayashi et al. | |
| 2007/0080128 | A1 | 4/2007 | Laveault et al. | |
| 2008/0011702 | A1 | 1/2008 | Walsh | |
| 2008/0047922 | A1 | 2/2008 | Olson et al. | |
| 2009/0178995 | A1 | 7/2009 | Tung et al. | |
| 2010/0326946 | A1 | 12/2010 | Hanafusa et al. | |
| 2011/0114649 | A1 | 5/2011 | Adams et al. | |
| 2011/0164948 | A1 | 7/2011 | Marshall et al. | |
| 2012/0031913 | A1 | 2/2012 | Moore et al. | |
| 2015/0013416 | A1 | 1/2015 | Hosoi | |
| 2015/0344166 | A1 | 12/2015 | Davis et al. | |

FOREIGN PATENT DOCUMENTS

| | | |
|---|---|---|
| CA | 2469238 | 6/2003 |
| CA | 2655925 | 1/2008 |
| DE | 6903478 | 5/1969 |
| EP | 1136154 | 9/2001 |
| EP | 2835188 | 2/2015 |
| EP | 2955131 | 12/2015 |
| FR | 2775206 | 8/1999 |
| JP | H07-211494 | 8/1995 |
| JP | 09-057384 | 3/1997 |
| JP | 2002-137032 | 5/2002 |
| JP | 2002-192272 | 7/2002 |
| JP | 2002-237902 | 8/2002 |
| JP | 2003-054687 | 2/2003 |
| JP | 2003-094133 | 4/2003 |
| JP | 2003-192093 | 7/2003 |
| JP | 2003-205924 | 7/2003 |
| JP | 2003-320432 | 11/2003 |
| JP | 2004-210403 | 7/2004 |
| JP | 2005-96843 | 4/2005 |
| JP | 3665002 | 6/2005 |
| JP | 2005-186164 | 7/2005 |
| JP | 2005-280768 | 10/2005 |
| JP | 2006-001619 | 1/2006 |
| JP | 2006-321541 | 11/2006 |
| JP | 2007-061881 | 3/2007 |
| JP | 2008-087071 | 4/2008 |
| JP | 4115133 | 7/2008 |
| JP | 4159956 | 10/2008 |
| JP | 2009-040461 | 2/2009 |
| JP | 2010-018336 | 1/2010 |
| JP | 4553350 | 9/2010 |
| JP | 4646164 | 12/2010 |
| JP | 2011-116456 | 6/2011 |
| JP | 4723762 | 7/2011 |
| JP | 2012-192984 | 10/2012 |
| JP | 5290569 | 9/2013 |
| JP | 5323757 | 10/2013 |
| JP | 2013-244996 | 12/2013 |
| JP | 5597333 | 10/2014 |
| JP | 5855233 | 2/2016 |
| JP | 5887340 | 3/2016 |
| WO | WO 94/20237 | 9/1994 |
| WO | WO 99/32363 | 7/1999 |
| WO | WO 01/92116 | 12/2001 |
| WO | WO 03/047991 | 6/2003 |
| WO | WO 03/057572 | 7/2003 |
| WO | WO 2004/018121 | 3/2004 |
| WO | WO 2007/030554 | 3/2007 |
| WO | WO 2008/089291 | 7/2008 |
| WO | WO 2009/091821 | 7/2009 |
| WO | WO 2010/117009 | 10/2010 |
| WO | WO 2011/059854 | 5/2011 |
| WO | WO 2011/147578 | 12/2011 |
| WO | WO 2012/133391 | 10/2012 |
| WO | WO 2012/144490 | 10/2012 |

OTHER PUBLICATIONS

"Ball Packaging Europe at drinktec 2013," Packaging Europe News Oct. 7, 2013, 2 pages [retrieved from: http://www.packagingeurope.com/Packaging-Europe-News/54154/Ball-Packaging-Europe-at-drinktec-2013.html].

U.S. Appl. No. 15/150,067, filed May 9, 2016, Robinson et al.

International Preliminary Report on Patentability for International (PCT) Patent Application No. PCT/US2014/028303, dated Sep. 24, 2015 9 pages.

Official Action for Canada Patent Application No. 2,903,308, dated Aug. 16, 2016 4 pages.

Extended Search Report for European Patent Application No. 14764861.2, dated Mar. 16, 2017 9 pages.

Official Action for Canada Patent Application No. 2,903,308, dated Apr. 3, 2017 4 pages.

* cited by examiner

METHOD AND APPARATUS FOR FORMING A THREADED NECK ON A METALLIC BOTTLE

CROSS-REFERENCE TO RELATED APPLICATIONS

This application claims priority under 35 U.S.C. §119(e) to U.S. Provisional Patent Application Ser. No. 61/799,214 filed Mar. 15, 2013, which is incorporated herein in its entirety by reference.

FIELD OF THE INVENTION

This invention provides an apparatus and methods of making and applying threaded twist-off neck finishes for metal containers. More specifically, the present invention relates to apparatus and methods used to form metallic bottles with threaded necks which are adapted to receive threaded closures.

BACKGROUND

Generally, the configuration and design of a container affects the level to which consumers, as well as bottlers, manufacturers, distributors, shippers, and retailers, are satisfied with the container. Factors believed to be of some importance in the container include the ability to offer consumers convenience and ensure for brand owners optimal brand presentation at the point of sale. Manufacturers and consumers alike have recognized that versatility is important in metal beverage container design and subsequent use. Metal beverage containers offer bottlers, distributors, and retailers an ability to stand out at the point of sale because metal beverage containers provide ideal surfaces to decorate with brand names, logos, designs, product information, and/or other preferred indicia. Metal beverage containers are particularly suitable for beer or mixed spirit-based beverages.

Metal beverage containers are also attractive to consumers because of the convenience they offer. Young, active, and mobile consumers like to know that they can enjoy their beverage "on the go" anywhere—whether in sport, at a concert, or in other leisure activities. Metal beverage containers are particularly suitable for such occasions because they are strong, give effective protection from light and air, and can be recycled after use.

Although metal beverage containers with a bottle shape are generally known in the container industry, metal beverage containers with a reliable, cost effective threaded twist-off crown neck finish are unavailable in the current market. Metal containers with pry-off and rolled-on neck finishes adapted for use with crown caps and other closure devices are known. However, the necks of metal containers with pry-off and rolled-on neck finishes are easily damaged or deformed during application and removal of the closure used to seal the container. Pry-off closures such as "crown caps" are also inconvenient because they require the consumer to use a separate opener to remove the closure from the container. The necks of metal containers sealed with a pry-off closure can become bent or damaged when the consumer improperly uses the opener or when the consumer uses an improper opener or surface to remove the closure. In addition, once the closure is removed, it cannot be used to reseal the container. Glass containers with threaded twist-off crown neck finishes are available and allow consumers to access the product without the need of a separate tool.

However, glass containers are typically heavier than metal containers, break easily, take longer to cool, and do not provide effective protection from sunshine and other ultraviolet exposure which may affect the quality and taste of the beverage.

SUMMARY OF THE INVENTION

Based on the unmet need for metal containers with threaded necks, the present invention provides an apparatus and methods for forming a twist-off crown neck on a metallic bottle in a cost-effective, reliable manner. One aspect of the present invention is to provide a method for forming a threaded neck on a metallic bottle. Another aspect of the present invention is to provide a metallic bottle with a threaded neck that has many novel features not offered by the prior art. One such feature is the threaded neck that has a geometry to receive a twist-off crown closure. In one embodiment, a metallic bottle has a threaded neck with a geometry to receive and engage a twist-off crown closure and/or a Roll On Pilfer Proof (ROPP) closure. In another embodiment, the metallic bottle has a threaded neck adapted to receive a ROPP closure with an interior diameter between about 0.90 inches and about 1.10 inches. In yet another embodiment, a metallic bottle has a threaded neck adapted to receive threaded closures known in the industry and used to close glass bottles.

In one embodiment, a method for forming a threaded neck on a neck portion of a metallic bottle is disclosed, the method generally comprising (1) forming a metallic bottle, the metallic bottle generally comprising a bottom dome portion, a generally cylindrical body portion, a neck portion extending upwardly from the body portion, a retention bead on the neck portion, and an opening positioned on an uppermost portion of the neck portion, wherein the neck portion is adapted to receive the threaded outsert; (2) forming a threaded outsert, the threaded outsert generally comprising a hollow cylindrical body portion and a threaded portion formed on an exterior surface portion of the hollow cylindrical body portion; (3) placing the threaded outsert over the neck portion of the metallic bottle, wherein the retention bead retains the threaded outsert in a predetermined position on the neck portion; and (4) expanding the uppermost portion of the neck portion above the threaded outsert to form a curl, wherein the threaded outsert is interconnected to the neck portion of the metallic bottle, and the threaded neck is adapted to receive a twist-off closure. In one embodiment, the method may further comprise forming sealing surfaces on the uppermost portion of the neck and on the curl above the threaded outsert. The sealing surfaces consist of rigid and dimensionally consistent surfaces adapted to contact a liner of the closure used to seal the metallic bottle. The metallic bottle may be formed using any metal known in the art, such as aluminum or steel. In one embodiment, the metallic bottle is formed by a draw and ironing process. In another embodiment, an impact extrusion process is used to form the metallic bottle. Optionally, the body of the metallic bottle may receive coatings on interior surfaces and exterior surfaces and the coatings may be cured to protect the metal from tooling contact or corrosion and to protect the contents of the bottle.

In one embodiment, the threaded outsert is formed by injection molding a plastic material. In another embodiment, the threaded outsert may be made of a metal material or any other suitable material known to those of skill in the art. In yet another embodiment, anti-rotation features are formed on at least one of an interior surface portion of the threaded outsert and an exterior surface portion of the neck portion of the metallic bottle before placing the threaded outsert over the neck portion. In another embodiment, an adhesive may optionally be applied to at least one of an interior surface portion of the threaded outsert and an exterior surface portion of the neck portion before placing the threaded outsert over the neck portion.

It is another aspect of the present invention to adapt the threaded neck to receive a closure of any size or thread geometry used to seal glass containers with a twist-off crown closure or a closure of any size and thread geometry known to those of skill in the art. In one embodiment, the threaded neck is adapted to receive a twist-off crown closure with a diameter of approximately 1.023 inches. In another embodiment, the closure is a twist-off crown cap. In yet another embodiment, the closure is a Roll On Pilfer Proof (ROPP) closure. In various embodiments, a consumer may remove the closure from a sealed metallic bottle of the current invention and then re-use the closure to selectively re-seal the metallic bottle.

In another embodiment, a metallic bottle with a threaded neck is disclosed, the metallic bottle generally comprising: a bottom portion; a generally cylindrical body portion; a neck portion extending upwardly from the body portion; a retention bead on the neck portion; a threaded outsert positioned on the neck portion above the retention bead; a curl formed on an uppermost portion of the neck portion, wherein the curl retains the threaded outsert to the neck portion; and an opening positioned on the neck portion above the curl, wherein the threaded neck has a predetermined geometry adapted to receive a twist-off closure. In one embodiment, the threaded outsert has a thickness between about 0.050 inches and about 0.150 inches and an exterior diameter between approximately 0.998 inches and approximately 1.023 inches. After filling the metallic bottle with a beverage, a threaded closure is applied to seal the opening to prevent leakage of liquid or gas. Optionally, an elastomeric disk or liner may be positioned in an interior portion of the closure. When the closure is applied to the metallic bottle, the elastomeric disk is compressed between sealing surfaces formed on the uppermost portion of the neck and the closure. In another embodiment, a sealant may optionally be applied to the metallic bottle or the closure before interconnecting the closure to the bottle.

It is another aspect of the present invention to provide a method for forming a threaded neck on a neck portion of a metallic bottle using rollers. The method generally comprises (1) forming the metallic bottle, the metallic bottle generally comprising a bottom dome portion, a body portion, and the neck portion extending upwardly from the body portion and an opening positioned on an uppermost portion of the neck; (2) forming the uppermost portion of the neck portion to create a curl with an increased metal thickness; (3) positioning the metallic bottle in a mandrel and rotating the metallic bottle around a substantially vertical axis of the metallic bottle; (4) positioning a vertical roller in contact with an interior surface portion of the neck portion of the metallic bottle; (5) positioning an exterior roller with a contoured surface portion in force applying contact with an exterior surface portion of the curl of the metallic bottle; and (6) providing a compressive force between the vertical roller and the exterior roller to form the threaded neck, the threaded neck adapted to receive a closure. In one embodiment, the exterior surface of the vertical roller may be contoured. In another embodiment, at least one of the vertical roller and the exterior roller may rotate around the substantially vertical axis of the metallic bottle, wherein the vertical roller and the exterior roller rotate in opposite directions. In yet another embodiment, the bottle is positioned within a mandrel, but the bottle remains stationary while the vertical roller and the exterior roller rotate about the stationary bottle to form the threaded neck on the bottle. In still another embodiment, two or more vertical rollers and two or more exterior rollers are used to form the threaded neck. Optionally, a first vertical roller has a contoured exterior surface and a second vertical roller has a smooth exterior surface. In yet another embodiment, a first exterior roller optionally has a contoured exterior surface with a profile different than a contoured exterior surface of a second exterior roller.

It is another aspect of the present invention to provide a method for forming a threaded neck on a neck portion of a metallic bottle using a cylindrical cutter to cut a curl of the metallic bottle. The method generally comprises (1) forming the metallic bottle, the metallic bottle generally comprising a bottom dome portion, a body portion, and the neck portion extending upwardly from the body portion and an opening positioned on an uppermost portion of the neck; (2) forming the uppermost portion of the neck portion to create the curl, the curl having an increased metal thickness; (3) positioning the metallic bottle in a mandrel and rotating the metallic bottle around a substantially vertical axis of the metallic bottle; (4) positioning cutting surfaces of the rotating cylindrical cutter in cutting contact the curl of the metallic bottle, wherein the cylindrical cutter is adapted to move laterally toward and away from the metallic bottle and vertically up and down while the cylindrical cutter is in cutting contact with the exterior surface portion of the curl; and (5) cutting the curl to form the threaded neck, the threaded neck having a geometry adapted to receive a closure. In one embodiment, the cutting surfaces of the cylindrical cutter may be contoured. In another embodiment, one or more of the cutting surfaces of the cylindrical cutter have a cutting profile that is different than one or more other cutting surfaces of the cylindrical cutter. In yet another embodiment, the bottle is positioned within a mandrel, but the bottle remains stationary while the cylindrical cutter rotates about the neck of the stationary bottle to form the threaded neck on the bottle. In another embodiment, a mandrel is inserted into the opening of the bottle to hold the bottle and provide support to the neck of the bottle while the cylindrical cutter cuts the threads into the neck. In still another embodiment, two or more cylindrical cutters may be used to cut the threads in the curl of the metallic bottle. In yet another embodiment, the cutting surfaces of one of the two or more cylindrical cutters are different than the cutting surfaces of another of the two or more cylindrical cutters. In still another embodiment, the cylindrical cutter is adapted to only move in the lateral direction.

It is another aspect of the present invention to provide a method of compression forming a threaded neck on a neck portion of a metallic bottle. The method generally comprises (1) forming the metallic bottle, the metallic bottle generally comprising a bottom dome portion, a body portion, and the neck portion extending upwardly from the body portion and an opening positioned on an uppermost portion of the neck; (2) forming the uppermost portion of the neck portion to create a curl having an increased metal thickness; (3) positioning the metallic bottle in a mandrel; (4) positioning a cylindrical mandrel in the opening of the metallic bottle in contact with an interior surface of the neck; (5) positioning two or more side molds around an exterior surface of the curl and the neck, wherein the two or more side molds have contact surfaces with a predetermined shape adapted to form the threads in the curl; and (6) moving the contact surfaces of the two or more side molds into contact with the exterior surface of the curl to apply a compressive force between the cylindrical mandrel and the side molds to compress the curl and the neck to form the threaded neck, the threaded neck having a geometry adapted to receive a closure. In one embodiment, a first of the two or more side molds has a first contact surface with a first predetermined shape and a second of the two or more side molds has a second contact surface with a different second predetermined shape. In another embodiment, the two or more side molds comprise three side molds, wherein each of the three side molds have contact surfaces with a different predetermined shape. In still another embodiment, the cylindrical mandrel is adapted to create a seal against the interior surface of the metallic bottle and introduce a gas into the interior of the metallic bottle to pressurize the interior and increase the rigidity of the metallic bottle. In yet another embodiment, a diameter of the cylindrical mandrel is adapted to expand after the cylindrical mandrel is positioned in the opening of the metallic bottle.

The above-described embodiments, objectives, and configurations are neither complete nor exhaustive. As will be appreciated, other embodiments of the invention are possible using, alone or in combination, one or more of the features set forth above or described in detail below.

Although generally referred to herein as "containers," "metallic bottles," "metal containers," and/or "bottles," it should be appreciated that the current invention may be used with containers of any size, shape, or material. Accordingly, the term "metallic bottle" is intended to cover containers of any type.

Further, references made herein to "twist-off crown necks," "twist-off crown closure," "crown caps," "Roll on Pilfer Proof Closures," "threaded closures," and "ROPP closures" should not necessarily be construed as limiting the present invention to a particular type of closure or a particular thread design. It should be appreciated that the current invention may be used to form threads on a metal container wherein the threads are suitable for any size and/or variety of closures known by those skilled in the art including, but not limited to, ROPP closures, crown caps, and twist-off caps. In addition, closures may be formed of any suitable material know in the art including metal or plastic.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1:
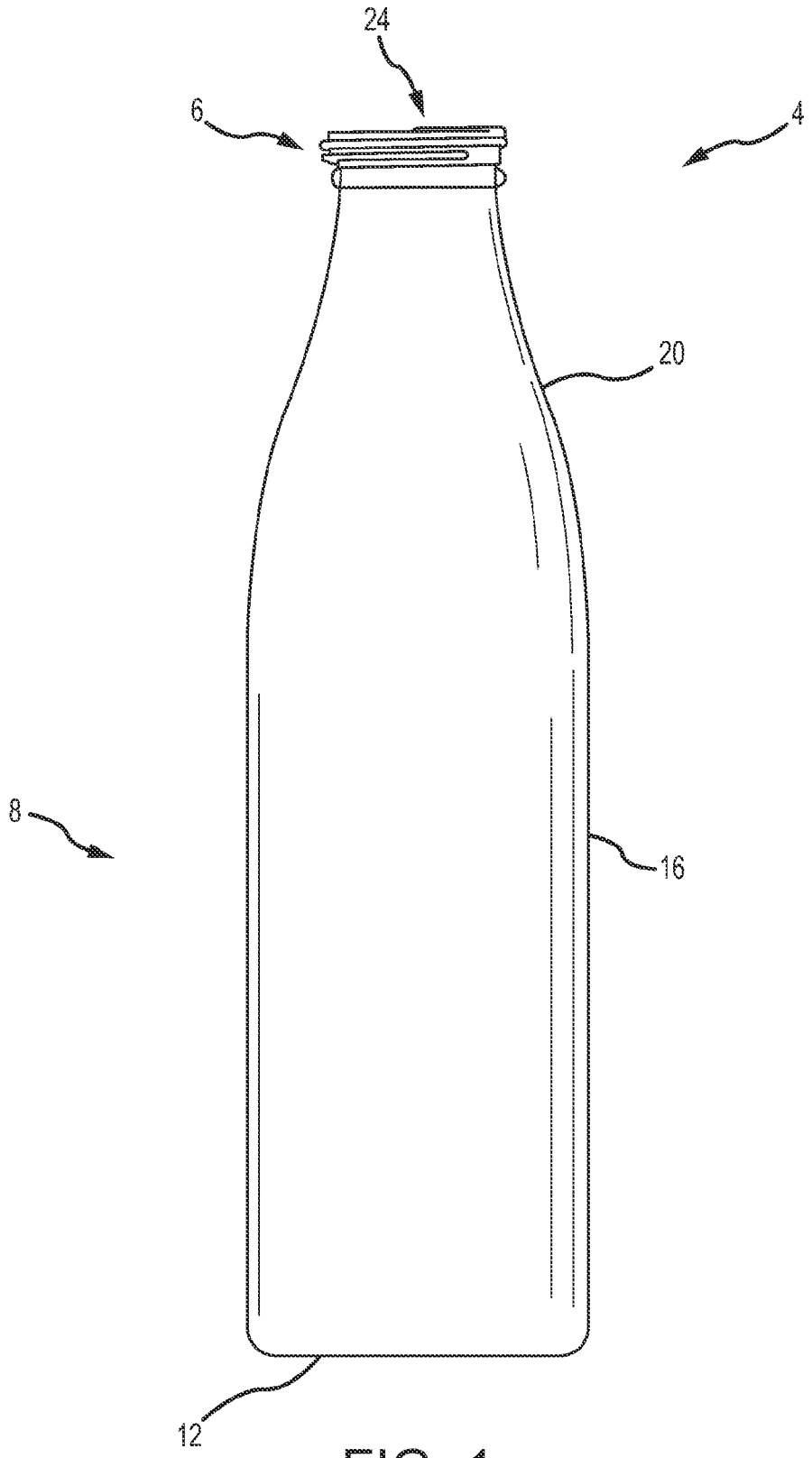
FIG. 1 is a front elevation view of a metallic bottle with a threaded outsert interconnected on a neck portion according to one embodiment of the present invention.

A component list of the various components shown in drawings is provided herein:

| Number | Component |
|---|---|
| 4 | metallic bottle |
| 6 | threaded outsert |
| 8 | body |
| 12 | bottom |
| 16 | sidewall |
| 20 | neck |
| 24 | opening |
| 28 | first exterior diameter |
| 32 | retention bead |
| 36 | second exterior diameter |
| 40 | neck exterior surface |
| 42 | cylindrical body of outsert |
| 44 | interior diameter of outsert |
| 46 | exterior diameter of outsert |
| 47 | exterior thread diameter |
| 48 | outsert height |
| 52 | outsert thickness |
| 56 | threads |
| 60 | helical ridges |
| 64 | exterior surface of outsert |
| 65 | first radius |
| 66 | second radius |
| 67 | thread flat portion |
| 68 | thread depth |
| 69 | thread pitch |
| 72 | interior surface of outsert |
| 76 | curl |
| 80 | uppermost surface |
| 82 | distance to start of first thread |
| 84 | distance to bottom of thread |
| 104 | metallic bottle |
| 108 | curl |
| 110 | vertical axis of bottle |
| 112 | vertical roller |
| 113 | rotation |
| 114 | vertical roller surface |
| 116 | axis |
| 118 | exterior roller |
| 119 | exterior roller surface |
| 120 | lateral movement |
| 122 | vertical movement |
| 124 | cylindrical cutter |
| 128 | cylindrical mandrel |
| 130 | side molds |
| 132 | contact surface |

DETAILED DESCRIPTION

Various embodiments of the present invention are described herein and as depicted in the drawings. The present invention has significant benefits across a broad spectrum of endeavors. It is the Applicants' intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Referring now to FIG. 1, a metallic bottle 4 is illustrated with a threaded outsert 6 according to one embodiment of the present invention. The metallic bottle 4 and threaded outsert 6 may be formed separately and the threaded outsert 6 interconnected to the metallic bottle 4 as described below. Alternatively, the threads may be formed as an integral portion of the neck of the metallic bottle, thus eliminating the need for an outsert.

Manners of forming metallic bottles 4 are generally known in the art. The metallic bottle is generally formed from a sheet of aluminum or steel in a draw and wall ironing (DWI) process or from a slug of aluminum or steel in an impact extrusion process. The metallic bottle 4 has a generally cylindrical body 8. Optionally, the metal body 8 is coated on all interior and exterior surfaces and the coatings cured to protect the metal of the body 8 from tooling contact, corrosion, and/or to protect the contents of the metallic bottle 4. The metal body 8 has a bottom dome portion 12. The metal body also has a sidewall portion 16, a neck portion 20 extending upwardly from the sidewall portion 16, and an opening 24 positioned on an uppermost portion of the neck 20.

Figure 2:
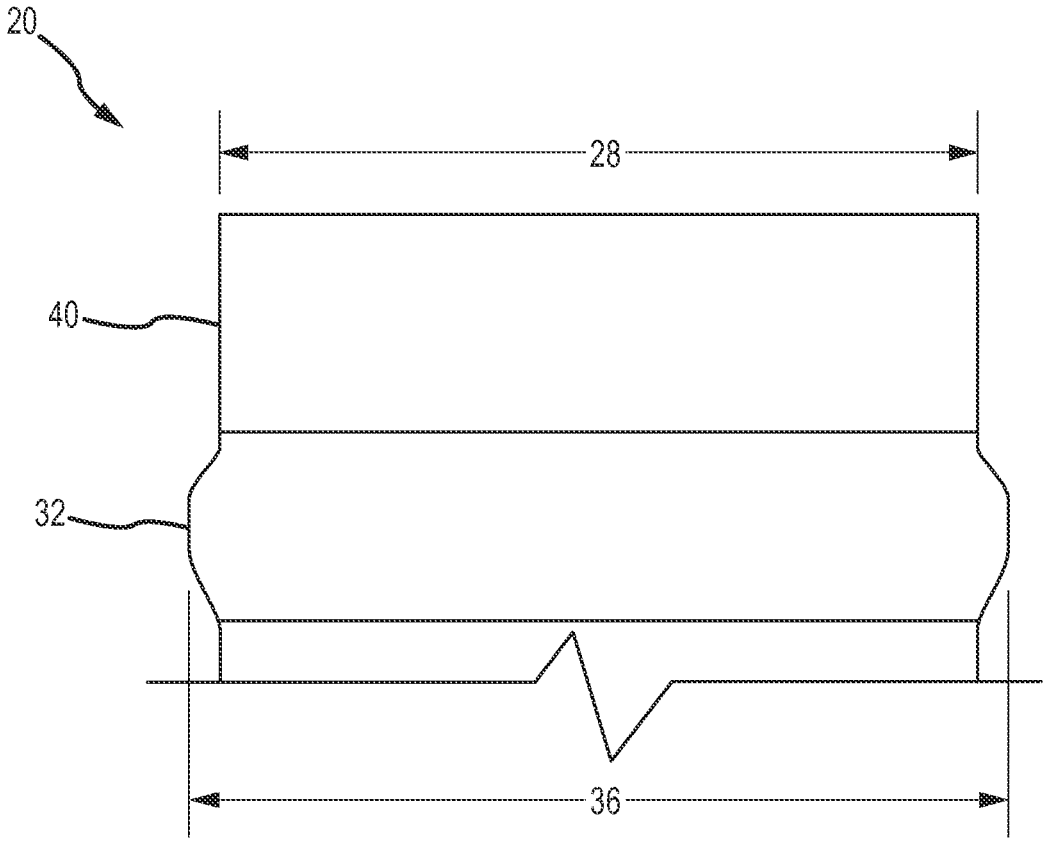
FIG. 2 is a fragmented front elevation view of a neck of a metallic bottle according to one embodiment of the present invention prior to interconnection of a threaded outsert to the neck.

Referring now to FIG. 2, a fragmented front elevation view of the neck 20 of the metallic bottle 4 is illustrated before interconnection of the threaded outsert 6 thereto. A series of die necking operations have been performed on the body 8 to reduce the diameter of the body 8 to form the neck 20 with a predetermined shape and diameter. Methods and apparatus used in necking metal containers are generally known in the art as disclosed in U.S. Pat. Nos. 4,403,493, 4,693,108, 4,732,027, 5,138,858, 5,448,903, 5,469,729, 5,713,235, 5,778,723, and 7,140,223 which are each incorporated herein by reference in their entirety. The uppermost portion of the neck 20 has a first predetermined exterior diameter 28. During the die necking operations, an expanded ring or retention bead 32 is formed with a second predetermined exterior diameter 36. Optionally, the exterior diameter 36 may match the diameter of the neck 20. The diameter 36 of the retention bead 32 is larger than the diameter 28 of the uppermost portion of the neck 20. The retention bead 32 retains the threaded outsert 6 in a predetermined position on the neck 20 to prevent the threaded outsert 6 from sliding. Optionally, anti-rotation features may be formed on an exterior surface 40 of the neck 20 to prevent inadvertent rotation or movement of the threaded outsert 6 when twisting a closure (not illustrated) threadably interconnected to the metallic bottle 4. In one embodiment, the anti-rotation features may be bumps, beads, or ridges, combinations thereof, or any other shape selected to increase the coefficient of friction between the exterior surface 40 of the neck 20 and an interior surface of the threaded outsert 6. In another embodiment, the anti-rotation feature is an adhesive or sealant applied to the exterior surface 40 of the neck 20 before interconnecting the threaded outsert 6 to the neck 20.

Figure 3A:
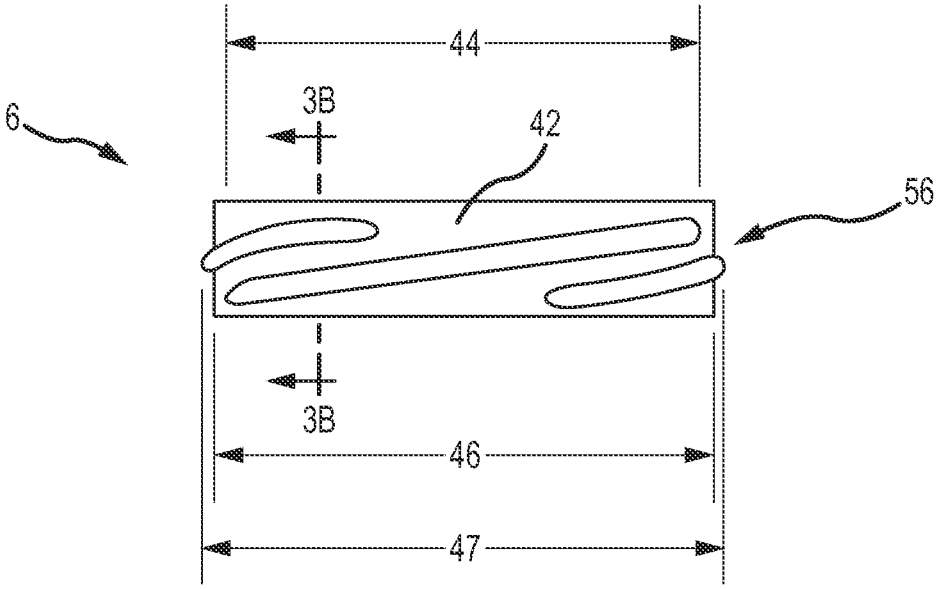
FIG. 3A is a front elevation view of a threaded outsert according to one embodiment of the present invention.

Referring now to FIG. 3A, the threaded outsert 6 is illustrated prior to interconnection to the metallic bottle 4. The threaded outsert 6 may be formed of metal, injection molded from a plastic material, or made of any other material known to those skilled in the art. The threaded outsert 6 is generally comprised of a hollow cylindrical body 42. Threads 56 are integrally formed on an exterior surface portion of the body 42 of the threaded outsert 6. The threaded outsert 6 has an interior diameter 44 large enough for the threaded outsert 6 to be placed on the neck 20 of the metallic bottle 4. As may be appreciated by one of skill in the art, the threaded outsert 6 has any interior diameter 44 larger than the first exterior diameter 28 of the neck 20, but less than the exterior diameter 36 of the retention bead 32. In one embodiment, the minimum interior diameter 44 of the threaded outsert 6 is less than approximately 0.95 inches, but the dimension is directly related to the size of the bottle neck, which can vary significantly based on the application. In one embodiment, the threaded outsert 6 has an exterior diameter 46 between approximately 0.998 inches and approximately 1.023 inches. In a preferred embodiment, the exterior diameter 46 of the threaded outsert 6 is approximately 1.010 inches. In one embodiment, an exterior diameter 47 of the threads 56 of the threaded outsert 6 is between approximately 1.038 inches and approximately 1.063 inches. In a preferred embodiment, the exterior diameter 47 of the threads 56 is approximately 1.05 inches.

Figure 3B:
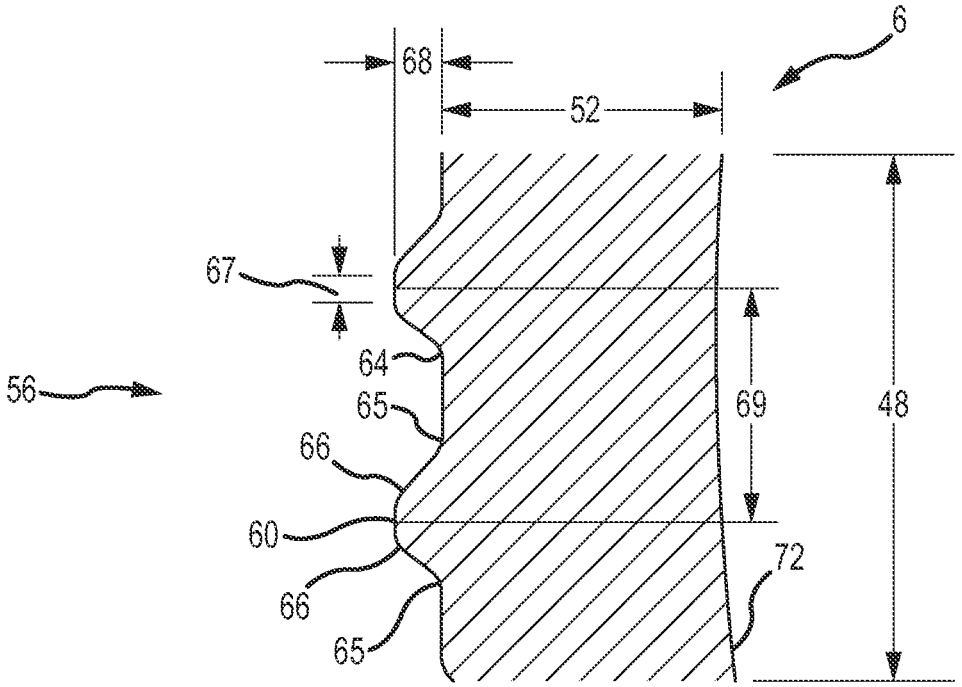
FIG. 3B is a cross-sectional front elevation view of the threaded outsert of FIG. 3A taken along line 3B.

FIG. 3B is a cross-sectional front elevation view of the threaded outsert 6 taken along line 3B-3B of FIG. 3A. In one embodiment, the threaded outsert 6 has a height 48 of between approximately 0.30 inches and approximately 0.60 inches. In another embodiment, a thickness 52 of the threaded outsert 6 is between approximately 0.050 inches and approximately 0.150 inches.

Helical ridges 60 form threads 56 on an exterior surface 64 of the threaded outsert 6. The threads 56 have a size, shape, alignment, and geometry similar to threads of glass containers which are generally known in the art as disclosed in drawings produced and distributed by the Glass Packaging Institute (GPI), including GPI drawing number 5457 for glass finish number 545 which is incorporated herein in its entirety by reference. In one embodiment, the threads 56 of the threaded outsert 6 have the dimension, shape, geometry, and alignment of threads described in GPI drawing number 5457. In another embodiment, threads 56 are adapted to interconnect with a ROPP closure with a diameter between approximately 0.90 inches and approximately 1.10 inches. In still another embodiment, the threads 56 have a first radius of curvature 65 of no more than approximately 0.020 inches. In yet another embodiment, the threads 56 have a second radius of curvature 66 of approximately 0.016 inches. In still another embodiment, the threads 56 may have an optional flat portion 67 with a maximum width of approximately 0.007 inches. In yet another embodiment, the threads 56 have a depth 68 of between approximately 0.15 inches and approximately 0.023 inches. In a preferred embodiment, the depth 68 of the threads 56 is approximately 0.20 inches. In still another embodiment, the threads 56 start approximately 90° apart and have four leads, each lead generally having 2.7 turns per inch, a thread lead of approximately 0.370 inches, a cutter diameter of approximately 0.500 inches, a helix angle of approximately 6° 31', and a minimum thread travel of approximately 108°. In yet another embodiment, the threads 56 have a pitch 69, or distance from the crest of one thread to the next crest, of approximately 0.093 inches. Although various dimensions have been provided to describe one exemplary embodiment of the threaded outsert 6 and the threads 56, it is expressly contemplated that dimensions of the threaded outsert 6 and the placement, dimensions, spacing, and geometry of the threads 56 may be varied and still comport with the scope and spirit of the present invention.

Optionally, anti-rotation features may be formed on an interior surface 72 of the threaded outsert 6 to prevent inadvertent rotation or movement of the threaded outsert 6 after interconnecting the threaded outsert 6 to the metallic bottle 4. For example, the anti-rotation features may prevent inadvertent rotation or movement of the threaded outsert 6 when a closure (not illustrated) is twisted to open the metallic bottle 4. In one embodiment, the anti-rotation features may be shapes such as bumps, beads, groves, protrusions, or ridges, or combinations thereof, or any other shape selected to increase the coefficient of friction between the exterior surface 40 of the neck 20 and the interior surface 72 of the threaded outsert 6. In another embodiment, the anti-rotation feature may be an adhesive or sealant applied to the interior surface of the threaded outsert 72 or to the exterior surface 40 of the neck 20 before interconnection of the threaded outsert 6 to the neck 20.

Figure 4A:
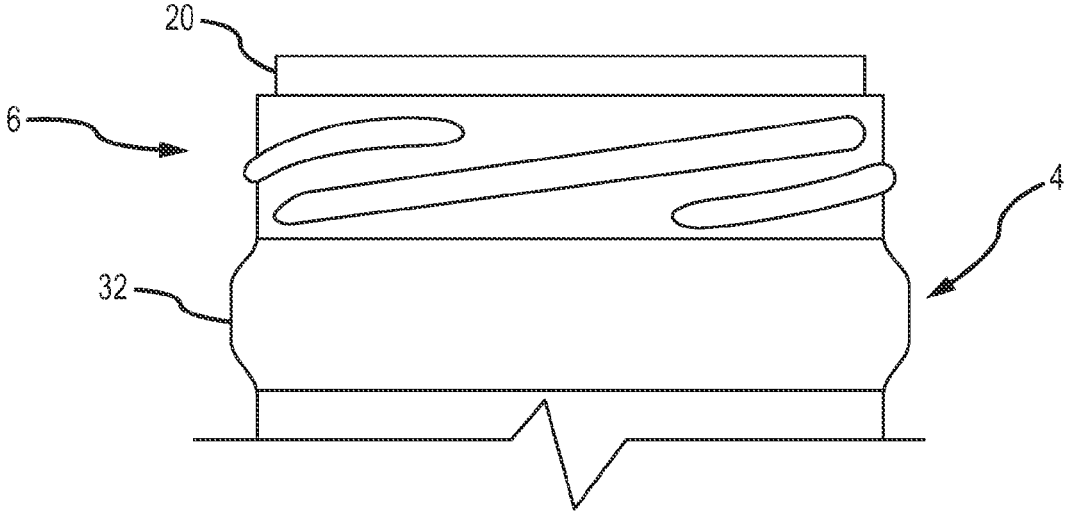
FIG. 4A is a fragmented front elevation view of the threaded outsert of FIG. 3A placed on the neck of the metallic bottle of FIG. 2.
Figure 4B:
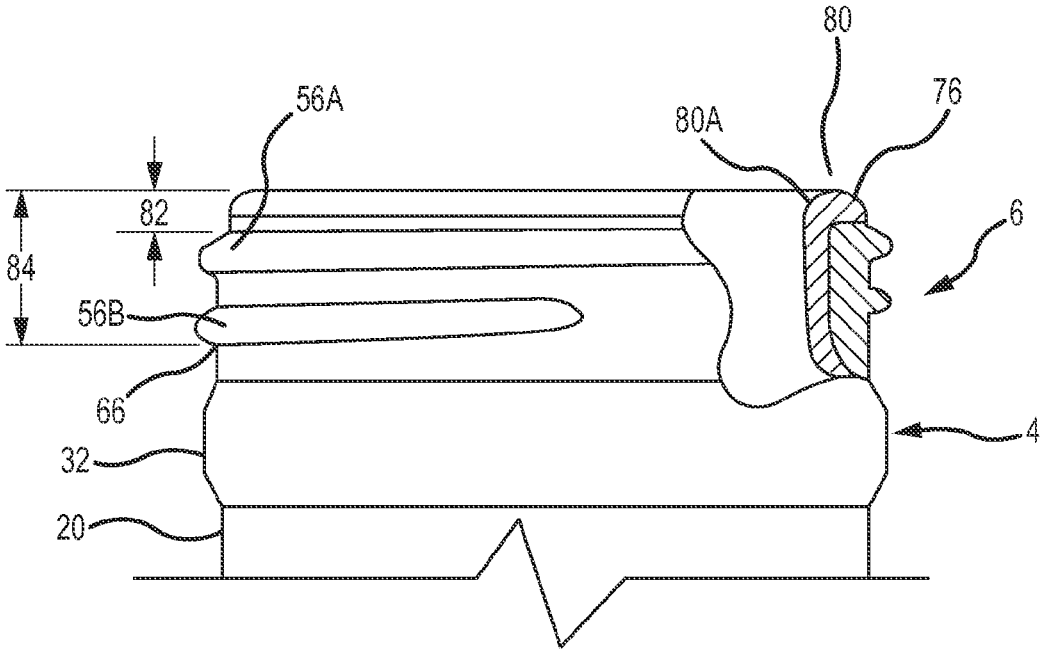
FIG. 4B is a fragmented, cross-sectional front elevation view of the threaded outsert of FIG. 3A interconnected to the neck of the metallic bottle of FIG. 2.

After forming the metallic bottle 4 and the threaded outsert 6, the outsert 6 is placed over the neck 20 as illustrated in FIG. 4A. The threaded outsert 6 is retained in a predetermined position by the retention bead 32. Referring now to FIG. 4B, a curling operation expands the neck 20 above the threaded outsert 6 to form a curl 76 to interconnect the threaded outsert 6 to the metallic bottle 4. The curl 76 is closed above the threaded outsert 6 to prevent unintended or inadvertent movement or rotation of the threaded outsert 6. In one embodiment, a radius of curvature of the curl 76 is between approximately 0.031 inches and approximately 0.063 inches. Sealing surfaces are formed on an uppermost surface 80 of the metallic bottle 4. The sealing surfaces are adapted to be rigid and dimensionally consistent to contact a liner of a closure to seal the metallic bottle 4 and prevent leakage of liquid or gas. The uppermost surface 80 is substantially parallel to the bottom 12 of the metallic bottle 4. In one embodiment, an interior surface portion 80A of the uppermost surface 80 has a maximum radius of curvature of approximately 0.031 inches. In another embodiment, a maximum distance 82 from the uppermost surface 80 of the metallic bottle 4 to the start of the first full thread 56A is approximately 0.088 inches. When the threads 56 are formed without the optional flat portion 67 (illustrated in FIG. 3B), the maximum distance 82 is approximately 0.095 inches. In still another embodiment, a minimum distance 84 of approximately 0.234 inches separates the uppermost surface 80 of the metallic bottle 4 from a bottom swing of the second radius 66 of a thread 56B at the lowest point at the end of the thread 56B. In yet another embodiment, the sealing surfaces of the upper surface 80 of the metallic bottle 4 have the dimensions and geometry described in GPI drawing number 5457.

Figure 5A:
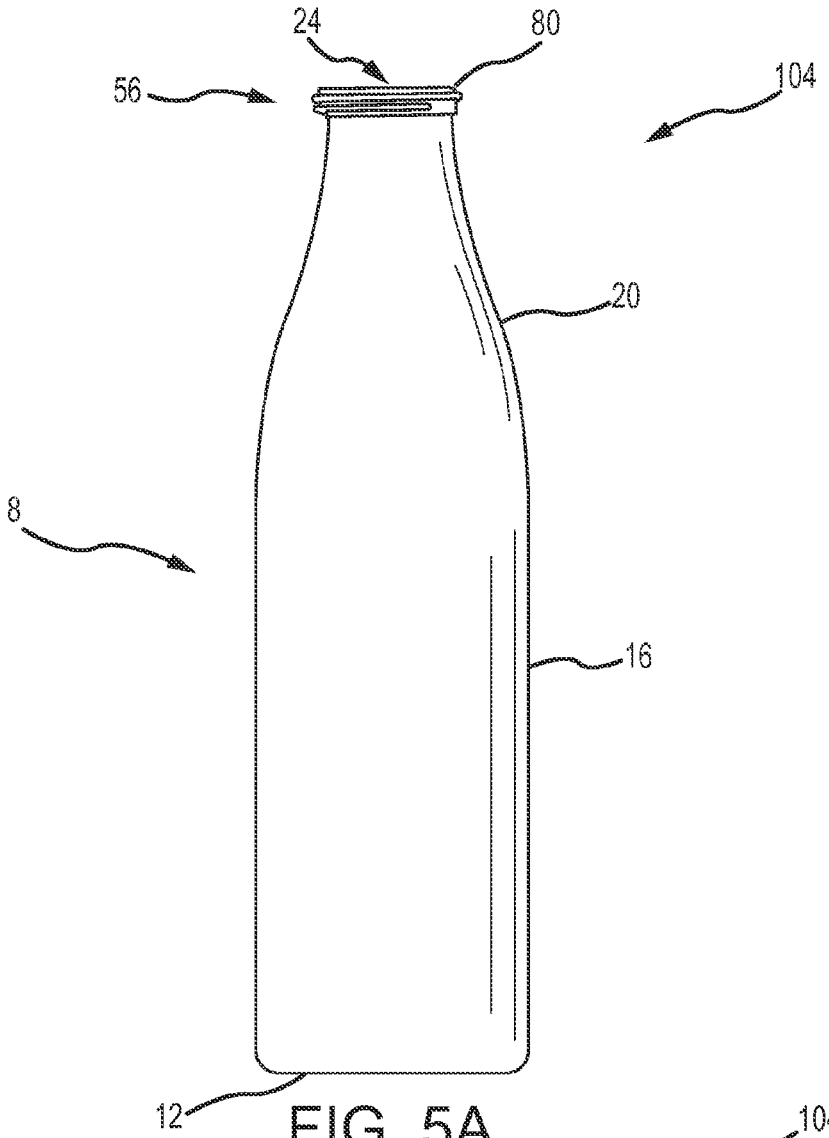
FIG. 5A is a front elevation view of a metallic bottle with a threaded neck portion formed according to certain embodiments of the present invention.

Referring now to FIG. 5A, a metallic bottle 104 is depicted with threads 56 on a neck portion 20 formed by rolling, cutting, or compression according to various embodiments of the present invention. The metallic bottle 104 may be formed, coated, and cured as described above in conjunction with FIG. 1. The metallic bottle has a metal body 8, a bottom dome portion 12, a sidewall portion 16, a neck portion 20 extending upwardly from the sidewall portion 16, and an opening 24 positioned on an uppermost portion 80 of the neck 20. The threads 56 and the uppermost portion 80 of the metallic bottle 104 have the dimensions and geometry described above in the text accompanying FIGS. 3A, 3B, and 4B. In one embodiment, the threads 56 and uppermost portion 80 of the metallic bottle 104 have the dimensions and geometry described in GPI drawing number 5457. However, as appreciated by one skilled in the art, any variety of sizes and dimensions can be utilized and practiced with the present invention depending on the required size of the bottle.

Figure 5B:
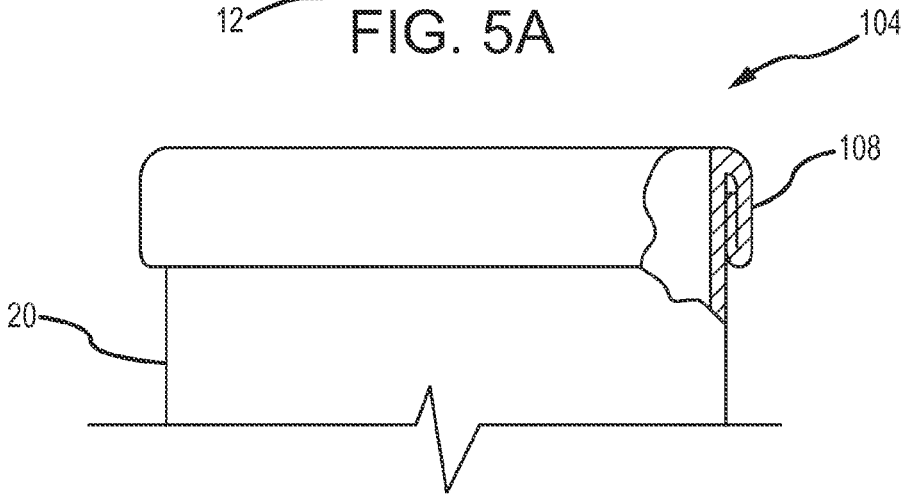
FIG. 5B is a fragmented, cross-sectional front elevation view of the curled neck of the metallic bottle of FIG. 5A before formation of the threaded neck portion.

Referring now to FIG. 5B, a cross-sectional front elevation of the neck 20 of the metallic bottle 104 is illustrated before threads have been formed thereon. The metallic bottle 104 has been necked to a predetermined diameter. A curl 108 of a predetermined size and thickness is formed on the neck 20. The curl 108 may optionally be formed of multiple rolls of the metal of the neck 20.

Figure 6:
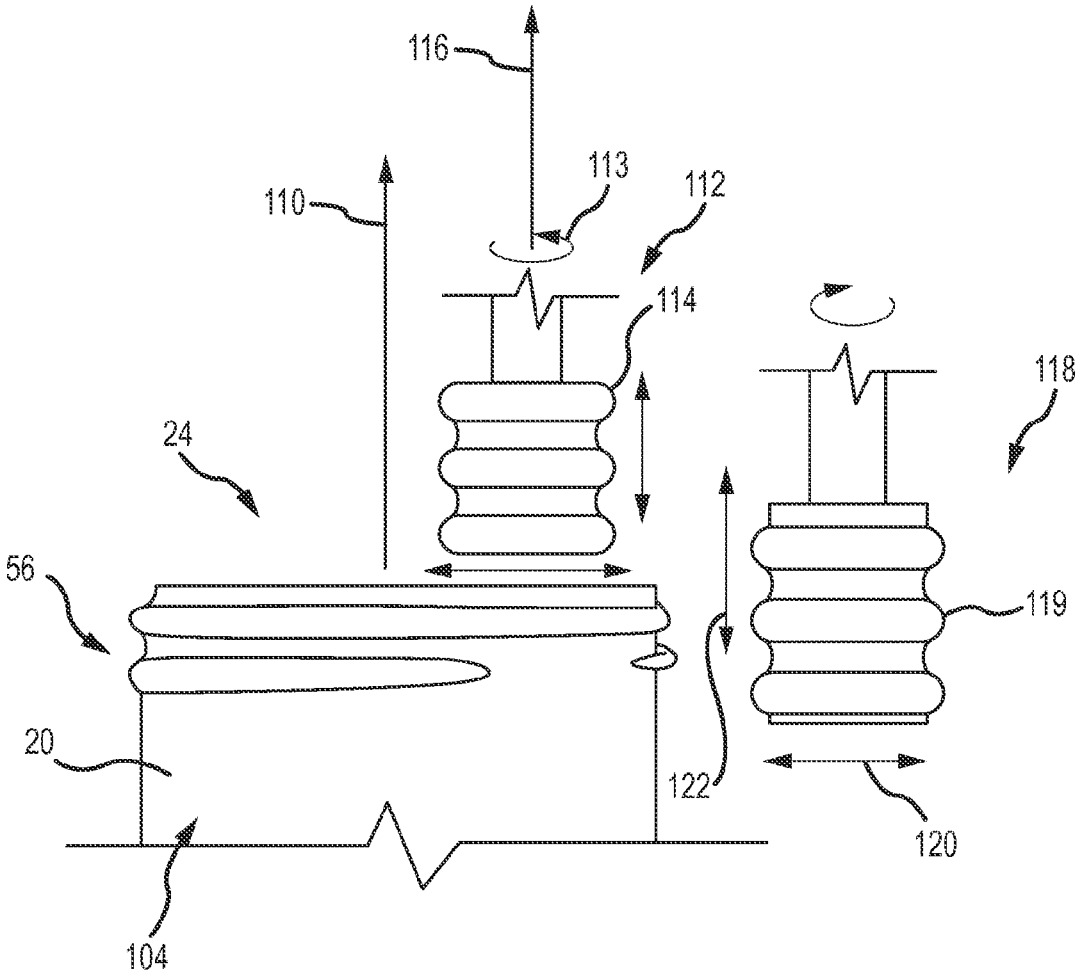
FIG. 6 illustrates a method of roll forming threads into the curled neck of the metallic bottle of FIG. 5B according to one embodiment of the present invention.

A method and apparatus of roll forming threads 56 on the metallic bottle 104 according to one embodiment of the present invention is illustrated in FIG. 6. The metallic bottle 104 is mounted in a mandrel (not illustrated) and the metallic bottle 104 is spun about a substantially vertical axis 110 extending through the center of the metallic bottle 104. A vertical roller 112 is inserted into the opening 24 of the spinning metallic bottle 104. In the illustrated embodiment, the vertical roller 112 has a contoured exterior surface 114; however, it is contemplated that the exterior surface 114 of the vertical roller 112 may be smooth or contoured. The vertical roller 112 rotates in a first direction 113 about an axis 116 which is substantially parallel to the axis 110 of the metallic bottle 104. An exterior roller 118 with a contoured exterior surface 119 of a predetermined shape is positioned on the exterior of the metallic bottle 104. The exterior roller 118 rotates in a second direction about a vertical axis substantially parallel to axis 110. The second direction is opposite to the first direction. Both the vertical roller 112 and the exterior roller 118 can move laterally as indicated by horizontal arrows 120 and/or vertically as indicated by vertical arrows 122. Although FIG. 6 illustrates the vertical roller 112 rotating in a counter-clockwise direction and the exterior roller 118 rotating in a clockwise direction, it is expressly contemplated that vertical roller 112 can rotate in the clockwise direction and the exterior roller 118 can rotate in the counter-clockwise direction and still comport with the scope and spirit of the present invention.

The exterior surface 114 of the vertical roller 112 is moved into contact with an interior surface of the neck 20 of the metallic bottle 104. The contoured exterior surface 119 of the exterior roller 118 is moved into contact with an exterior surface portion of the curl 108 (illustrated in FIG. 5B) of the neck 20. The surfaces 114, 119 of the vertical roller 112 and the exterior roller 118 apply a compressive force therebetween to the curl 108 of the metallic bottle 104 to form threads 56 of a predetermined size, shape, and geometry in the neck portion 20 of the metallic bottle 104. During the threading, both the vertical and exterior rollers 112, 118 may move laterally and vertically and the vertical roller 112 provides support to the neck 20 of the metallic bottle 104. The surface 114 of the vertical roller 112 may optionally form a predetermined shape or profile on the interior surface of the neck 20 of the metallic bottle 104. In one embodiment, the metallic bottle 104 is mounted in a mandrel, but the bottle 104 remains stationary while the vertical and exterior rollers 112, 118 rotate about the bottle 104 during the threading.

Figure 7:
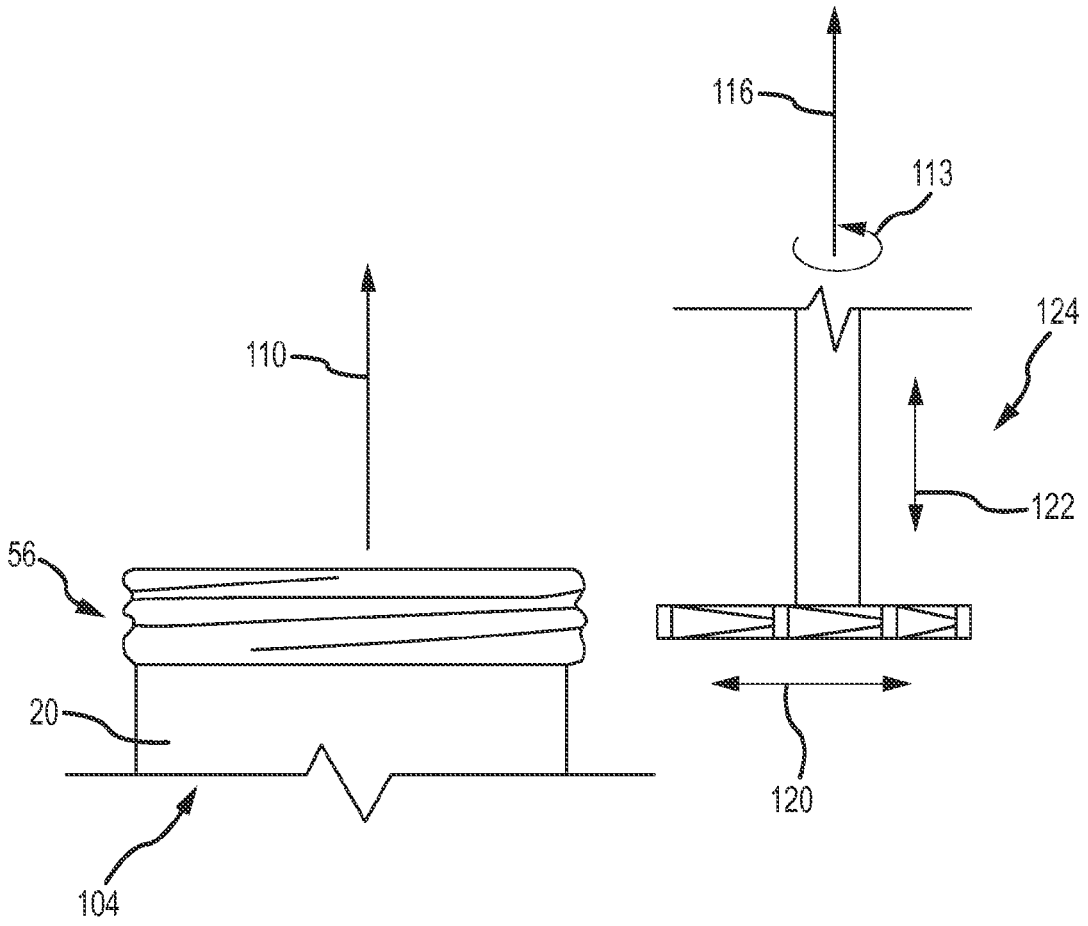
FIG. 7 illustrates a method of cutting threads into the curled neck of the metallic bottle of FIG. 5B according to one embodiment of the present invention.

A method and apparatus of cut forming threads 56 on the metallic bottle 104 according to another embodiment of the present invention is illustrated in FIG. 7. The metallic bottle 104 is positioned in a mandrel (not illustrated) and spun about the substantially vertical axis 110 extending through the metallic bottle 104. At least one cylindrical cutter 124 rotates 113 about the axis 116 substantially parallel to axis 110 and moves both laterally 120 and vertically 122. Alternatively, the cylindrical cutter 124 moves only in a lateral direction 120. Cutting surfaces of the cylindrical cutter 124 are moved into cutting contact with the exterior surface of the curl 108 (illustrated in FIG. 5B) to cut threads into the neck portion 20 of the metallic bottle 104. Optionally, in one embodiment, a mandrel may hold the bottle 104 stationary while the cylindrical cutter 124 moves around the bottle 104 to cut threads into the neck portion of the bottle 104. In another embodiment, a mandrel 128 (illustrated in FIG. 8) may optionally be inserted into the opening 24 of the bottle 104 to hold the bottle and provide support to the neck 20 of the bottle 104 while the cylindrical cutter 124 cuts the threads 56 into the neck 20. In yet another embodiment, one or more of the cutting surfaces of the cylindrical cutter have a cutting profile that is different than one or more other cutting surfaces of the cylindrical cutter. In still another embodiment, two cylindrical cutters are used to cut the threads in the exterior surface of the curl.

Figure 8:
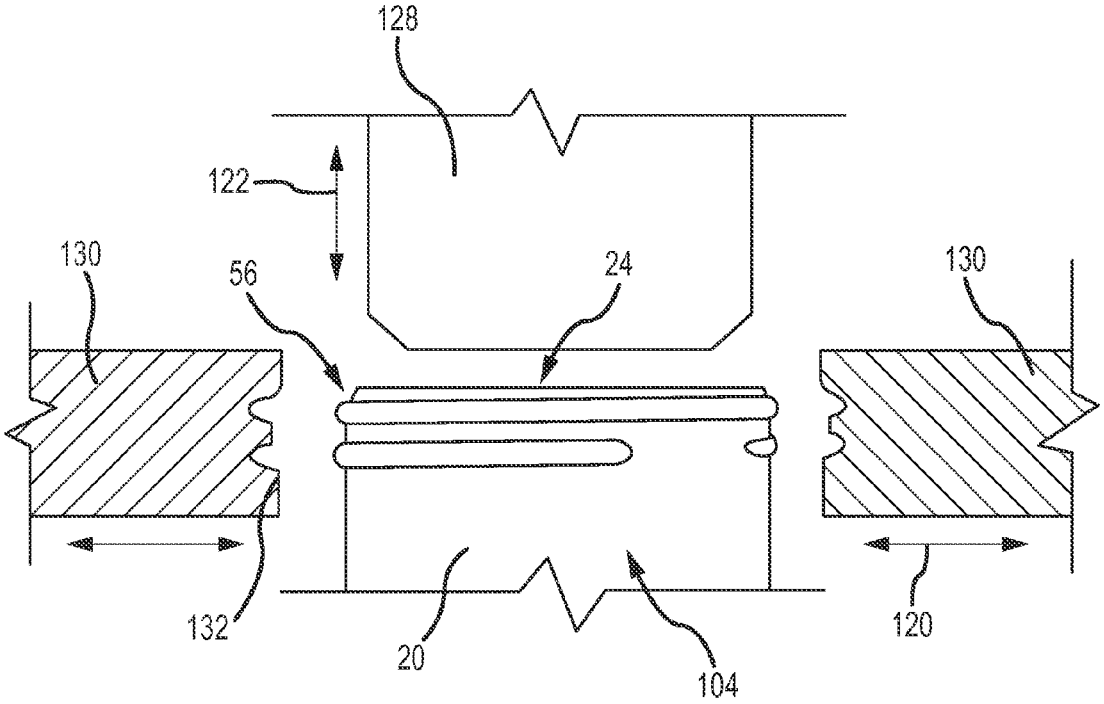
FIG. 8 illustrates a method of compression forming threads into the curled neck of the metallic bottle of FIG. 5B according to one embodiment of the present invention.

Referring now to FIG. 8, a method and apparatus of compression forming threads 56 on the metallic bottle 104 is illustrated. The metallic bottle 104 is positioned in a mandrel (not illustrated) that provides support to the metallic bottle. A cylindrical mandrel 128 that moves vertically 122 is inserted into the opening 24 of the metallic bottle 104 in force receiving contact with an interior surface of the neck 20. Optionally, in one embodiment, the cylindrical mandrel 128 may seal the interior of the metallic bottle 104 and introduce a gas, such as air, into the interior of the metallic bottle 104 to pressurize the interior and increase the rigidity of the metallic bottle 104. Two or more side molds 130 are positioned around the exterior surface of the curl 108 (illustrated in FIG. 5B) of the metallic bottle 104. The side molds 130 have contact surfaces 132 with a predetermined shape adapted to form threads 56 in the curl 108 of the metallic bottle 104. The contact surfaces 132 of each of the two or more side molds 130 can have a different predetermined shape. The side molds 130 close around the neck 20 and create a compressive force between the mandrel 128 and side molds 130 to compress the curl 108 and the neck 20 and form the threads 56 in the neck 20 of the metallic bottle 104.

Threaded metallic bottles 4, 104 of the present invention are adapted to be sealed with a threaded closure (not illustrated). The closure may be formed of steel, plastic, or any other material known to those of skill in the art. The closure can be of any size or geometry known in the industry, such as closures currently used to seal glass bottles of all sizes. After the threaded metallic bottle 4, 104 is filled with a selected product, the closure is placed over the opening 24 and threadably engaged with the threads 56 by methods known in the art to seal the product into the metallic bottle 4, 104 without leakage of liquid or gas. One or more interior surfaces of the closure contact and apply a sealing force to the sealing surfaces formed on the uppermost surface 80 of the metallic bottles 4, 104. The closure may optionally have an elastomeric disk that contacts and is compressed between the uppermost surface 80 of the metallic bottles 4, 104 and the closure. In one embodiment, a sealant may be applied to the uppermost surface 80 or to the interior surface of the closure before placing the closure over the opening 24. To open a sealed metallic bottle 4, 104, the consumer rotates the closure causing the helical ridges 60 of the threads 56 to drive the closure loose and off of the metallic bottle 4, 104.

The present invention has many benefits compared to prior art metal bottles. The threaded neck portion of a metallic bottle of the present invention allows the metallic bottle to be sealed with closures of known sizes. Closures used to seal metallic bottles of the present invention may be removed without the use of a separate tool. Once opened, the metallic bottles of the present invention may be selectively resealed by threading a closure that has been removed from the metallic bottle back onto the bottle.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A method for forming a threaded neck on a neck portion of a metallic bottle, comprising:

providing a metallic bottle comprising a bottom dome portion, a body portion, said neck portion extending upwardly from said body portion, and an opening positioned on an uppermost portion of said neck portion, wherein said neck portion is adapted to receive a plastic threaded outsert;

die necking an uppermost portion of said neck portion to reduce a diameter of said uppermost portion;

forming a retention bead on said reduced diameter neck portion which has an outer diameter that is larger than said reduced diameter neck portion, said retention bead having an upwardly oriented shoulder on an uppermost portion of said retention bead;

forming said plastic threaded outsert, having a hollow cylindrical body portion and threads extending from an exterior surface, wherein said outer diameter of said retention bead is greater than an outer diameter of said exterior surface of said plastic threaded outsert;

placing said plastic threaded outsert over said reduced diameter neck portion of said metallic bottle such that a lowermost portion of said plastic threaded outsert is proximate to said upwardly oriented shoulder, wherein said upwardly oriented shoulder engages substantially the entire lowermost portion of said plastic threaded outsert to prevent said plastic threaded outsert from sliding in a downward direction on said neck portion of said metallic bottle; and outwardly bending said reduced diameter neck portion above said plastic threaded outsert to form a flange with a distal end extending outwardly and away from said neck portion to form a substantially horizontally oriented shoulder adapted to engage an uppermost portion of said plastic threaded outsert, said flange having an outer diameter that is less than said outer diameter of said retention bead, wherein said plastic threaded outsert is interconnected to said neck portion of said metallic bottle, and wherein said threaded neck is adapted to receive a twist-off closure.

2. The method of claim 1, wherein a distance between crests of said threads formed on said plastic threaded outsert is approximately 0.093 inches such that said threads are adapted to receive the twist-off closure with an interior diameter of less than about 1.10 inches.

3. The method of claim 1, further comprising forming anti-rotation beads on an exterior surface portion of said neck portion of said metallic bottle before said plastic threaded outsert is placed over said neck portion, said anti-rotation beads increasing a coefficient of friction between said exterior surface portion and said plastic threaded outsert.

4. The method of claim 1, wherein said hollow cylindrical body portion of said plastic threaded outsert has an interior diameter of less than about 0.95 inches such that said threaded neck of said metallic bottle is adapted to receive said twist-off closure having an interior diameter of between about 1.0 inches and about 1.10 inches.

5. The method of claim 1, wherein said outer diameter of said flange is less than an outer diameter of said exterior surface of said plastic threaded outsert such that the plastic threaded outsert forms a substantially smooth transition from said flange to said exterior surface.

6. The method of claim 1, wherein said twist-off closure is a roll on pilfer proof closure.

7. The method of claim 1, wherein said threads formed on said plastic threaded outsert have a depth of between approximately 0.15 inches and approximately 0.023 inches.

8. The method of claim 7, wherein said plastic threaded outsert has a height between approximately 0.30 inches and approximately 0.60 inches.

9. The method of claim 8, wherein said hollow cylindrical body of said plastic threaded outsert has a thickness between about 0.050 inches and about 0.150 inches.

10. The method of claim 9, wherein said outer diameter of said exterior surface of said plastic threaded outsert is between approximately 0.998 inches and approximately 1.023inches such that said threaded neck is adapted to receive the twist-off closure having an interior diameter of less than about 1.10 inches.

11. The method of claim 1, wherein said outer diameter of said retention bead is about equal to an outer diameter of said threads formed on said plastic threaded outsert.

* * * * *